US010000949B2

(12) United States Patent
Vazquez et al.

(10) Patent No.: US 10,000,949 B2
(45) Date of Patent: Jun. 19, 2018

(54) APPARATUS AND METHOD FOR PREVENTING UNDESIRED ENGAGEMENT OF HOLD OPEN LEVER IN A LATCH

(71) Applicants: Francisco Javier Vazquez, Chihuahua (MX); Alfredo Martinez, Chihuahua (MX); Donald M. Perkins, Sterling Heights, MI (US)

(72) Inventors: Francisco Javier Vazquez, Chihuahua (MX); Alfredo Martinez, Chihuahua (MX); Donald M. Perkins, Sterling Heights, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 378 days.

(21) Appl. No.: 14/229,212

(22) Filed: Mar. 28, 2014

(65) Prior Publication Data

US 2014/0292000 A1 Oct. 2, 2014

Related U.S. Application Data

(60) Provisional application No. 61/806,530, filed on Mar. 29, 2013.

(51) Int. Cl.

| | |
|---|---|
| ***E05C 19/10*** | (2006.01) |
| ***E05B 81/14*** | (2014.01) |
| ***E05B 83/18*** | (2014.01) |

(52) U.S. Cl.

CPC ..... *E05B 81/15* (2013.01); *E05B 83/18* (2013.01); *Y10T 292/0949* (2015.04)

(58) Field of Classification Search

CPC ..... Y10T 292/108; Y10T 292/0949; Y10T 292/1048; E05B 81/15; Y10S 292/23

(Continued)

(56) References Cited

U.S. PATENT DOCUMENTS

| | | | |
|---|---|---|---|
| 3,695,662 | A | 10/1972 | Ploughman |
| 3,969,789 | A | 7/1976 | Wize |

(Continued)

FOREIGN PATENT DOCUMENTS

| | | | |
|---|---|---|---|
| CN | 1590688 | A | 3/2005 |
| CN | 101424146 | A | 5/2009 |

(Continued)

OTHER PUBLICATIONS

English Translation to CN 1101424146 Abstract.

(Continued)

*Primary Examiner* — Mark A Williams

(74) *Attorney, Agent, or Firm* — Cantor Colburn LLP

(57) ABSTRACT

A latch is disclosed herein. The latch having: a fork bolt movably mounted to the latch for movement between an open position and a closed position; a detent lever movably mounted to the latch for movement between a latched position and a released position, wherein the detent lever prevents the fork bolt from moving from the closed position to the open position when the detent lever is in the latched position; a hold open lever configured to engage and retain the detent lever when it moves from the latched position to the released position; and wherein the fork bolt is configured to disengage the hold open lever from the detent lever when the fork bolt travels away from the closed position.

19 Claims, 8 Drawing Sheets

(58) Field of Classification Search
USPC ..... 292/100
See application file for complete search history.

(56) References Cited

U.S. PATENT DOCUMENTS

| | | | | |
|---|---|---|---|---|
| 5,667,260 | A | 9/1997 | Weyerstall | |
| 5,802,894 | A | 9/1998 | Jahrsetz et al. | |
| 5,997,055 | A | 12/1999 | Strathmann | |
| 6,053,543 | A | 4/2000 | Arabia, Jr. et al. | |
| 6,378,920 | B1 * | 4/2002 | Ostrowski | E05B 83/16 292/216 |
| 6,382,687 | B1 | 5/2002 | Gruhn | |
| 6,568,741 | B1 | 5/2003 | Leung | |
| 6,575,507 | B2 | 6/2003 | Reddmann | |
| 6,679,531 | B2 * | 1/2004 | Rogers, Jr. | E05B 83/16 292/216 |
| 7,210,714 | B2 | 5/2007 | Berghahn et al. | |
| 8,348,310 | B2 * | 1/2013 | Vazquez | E05B 85/26 292/216 |
| 8,480,138 | B2 | 7/2013 | Bendel et al. | |
| 8,876,176 | B2 | 11/2014 | Spurr et al. | |
| 8,955,889 | B2 | 2/2015 | Bendel et al. | |
| 2001/0005079 | A1 | 6/2001 | Takamura | |
| 2002/0089188 | A1 | 7/2002 | Edgar | |
| 2003/0116977 | A1 | 6/2003 | Erices | |
| 2003/0127866 | A1 | 7/2003 | Martinez et al. | |
| 2003/0178858 | A1 | 9/2003 | Spurr et al. | |
| 2004/0075284 | A1 | 4/2004 | Hillgaertner | |
| 2004/0201226 | A1 | 10/2004 | Spurr | |
| 2004/0227358 | A1 | 11/2004 | Kachouh | |
| 2005/0087994 | A1 | 4/2005 | Umino | |
| 2006/0006670 | A1 | 1/2006 | Song | |
| 2006/0006671 | A1 | 1/2006 | Noel et al. | |
| 2006/0163883 | A1 | 7/2006 | Hoshikawa et al. | |
| 2008/0217928 | A1 | 9/2008 | Spurr | |
| 2010/0052336 | A1 | 3/2010 | Bendel et al. | |
| 2010/0127511 | A1 | 5/2010 | Vasquez et al. | |
| 2010/0127512 | A1 | 5/2010 | Vazquez et al. | |
| 2010/0244466 | A1 | 9/2010 | Tomaszewski | |
| 2011/0031765 | A1 * | 2/2011 | Vazquez | E05B 85/26 292/217 |
| 2011/0204659 | A1 | 8/2011 | Estrada et al. | |
| 2012/0292927 | A1 | 11/2012 | Vazquez et al. | |
| 2014/0292000 | A1 | 10/2014 | Vazquez et al. | |

FOREIGN PATENT DOCUMENTS

| | | | |
|---|---|---|---|
| CN | 103132823 | B | 9/2015 |
| DE | 29623782 | U1 | 11/1999 |
| EP | 0603934 | A1 | 12/1993 |

OTHER PUBLICATIONS

English Translation to CN 1590688 Abstract.
Chinese Office Action dated Jan. 14, 2016.
English Translation for Chinese Office Action dated Jan. 14, 2016.
CN Office Action for Application No. 201410125605.3; dated Feb. 28, 2017.
CN Office Action for Application No. 201410649461.1; dated Feb. 21, 2017.
CN Office Action for Application No. 201410649461.1; dated Jun. 20, 2016.
English Translation of CN Office Action for Application No. 201410125605.3; dated Feb. 28, 2017.
English Translation to CN 103132823 Abstract.
English Translation to CN Office Action for Application No. 201410649461.1; dated Feb. 21, 2017.
English Translation to CN Office Action for Application No. 201410649461.1; dated Jun. 20, 2016.
Search Report for CN Application No. 201410649461.1; dated Feb. 8, 2017.
Search Report for CN Application No. 201410649461.1; dated Jun. 6, 2016.

* cited by examiner

APPARATUS AND METHOD FOR PREVENTING UNDESIRED ENGAGEMENT OF HOLD OPEN LEVER IN A LATCH

CROSS REFERENCE TO RELATED APPLICATIONS

This application claims the benefit of U.S. Provisional Application Ser. No. 61/806,530 filed Mar. 29, 2014 the contents of which are incorporated herein by reference thereto.

BACKGROUND

Certain passenger vehicles are equipped with a rear vehicle storage compartment, commonly known as a trunk. The trunk is closed by a deck lid that is hinged to the vehicle body and swings open to provide access to the storage compartment. Similarly, other vehicles are equipped with a lift gate that allows access to the rear of the vehicle through a gate that is hinged at or near the roof line of a vehicle and opens upward. Other vehicles have sliding doors that run horizontally on a track between an opened and closed position. Each of the deck lid, lift gate or sliding door can be thought of as panels that allow access to the interior of the vehicle compartment. Compartment latches, enable each of these types of panels to be secured and closed.

When it is desired to open these panels, it is known to use a remote unlatch mechanism that releases a detent lever from engagement with a fork bolt, allowing a striker pin to be removed from the catch (or throat) of the fork bolt. Advantageously, the deck lid, lift gate or sliding door will release from the striker pin and bias away from the striker due to shocks, springs, motors etc. incorporated in these panels. However, when the panel does not bias away, the remote unlatch mechanism that causes the detent lever to be released from engagement with the fork bolt is de-energized. As a result, the detent lever risks falling back into engagement with the fork bolt and the panel cannot be opened. When the panel does not automatically bias open upon release of the detent lever from the fork bolt, it would be advantageous to maintain the detent lever in a released position until such time as the panel can be manually opened.

One solution to this is to provide a hold open lever, which is configured to maintain the detent lever in an open position after it has been power released so that the fork bolt can subsequently be moved into an open position without the detent lever moving back to a closed or locked position prior to the fork bolt being moved to the open position.

However, it is also desirable to provide an apparatus, or feature or method of operation that prevents the hold open lever from engaging or holding the detent lever in an open position that is inconsistent with an intended operation of the latch.

SUMMARY OF THE INVENTION

In one non-limiting embodiment, a latch is provided. The latch having: a fork bolt movably mounted to the latch for movement between an open position and a closed position; a detent lever movably mounted to the latch for movement between a latched position and a released position, wherein the detent lever prevents the fork bolt from moving from the closed position to the open position when the detent lever is in the latched position; a hold open lever configured to engage and retain the detent lever when it moves from the latched position to the released position; and wherein the fork bolt is configured to disengage the hold open lever from the detent lever when the fork bolt travels away from the closed position.

In yet another embodiment of the present invention, a latch is provided. The latch having: a fork bolt movably mounted to the latch for movement between an open position and a closed position; a detent lever movably mounted to the latch for movement between a latched position and a released position, wherein the detent lever engages the fork bolt and prevents the fork bolt from moving from the closed position to the open position when the detent lever is in the latched position; a hold open lever movably mounted to the latch for movement between a first position and a second position, wherein the hold open lever is configured to engage and retain the detent lever in the released position when the hold open lever is in the first position and wherein the hold open lever allows the detent lever to travel into the latched position when the hold open lever is in the second position, wherein the hold open lever is spring biased into the first position and the detent lever is spring biased into the latched position; and wherein the fork bolt has a first feature configured to move the hold open lever from the first position to the second position when the fork bolt travels from the latched position to the open position and wherein the fork bolt has a second feature configured to move the hold open lever from the first position to the second position when the fork bolt travels to the closed position and wherein the second feature only contacts the hold open lever when the fork bolt travels to an over travel position which is slightly past the closed position of the fork bolt.

According to yet another embodiment, a method of disengaging a hold open lever from engagement with a detent lever of a latch is provided. The method including the steps of: pivotally mounting a fork bolt to the latch for movement between an open position and a closed position; pivotally mounting the detent lever to the latch for movement between a latched position and a released position, wherein the detent lever engages the fork bolt and prevents the fork bolt from moving from the closed position to the open position when the detent lever is in the latched position; movably mounting the hold open lever to the latch for movement between a first position and a second position, wherein the hold open lever is configured to engage and retain the detent lever in the released position when the hold open lever is in the first position and wherein the hold open lever allows the detent lever to travel into the latched position when the hold open lever is in the second position, wherein the hold open lever is spring biased into the first position and the detent lever is spring biased into the latched position; and moving the hold open lever from the first position towards the second position with a feature of the fork bolt when the fork bolt is moved to a position past the closed position.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
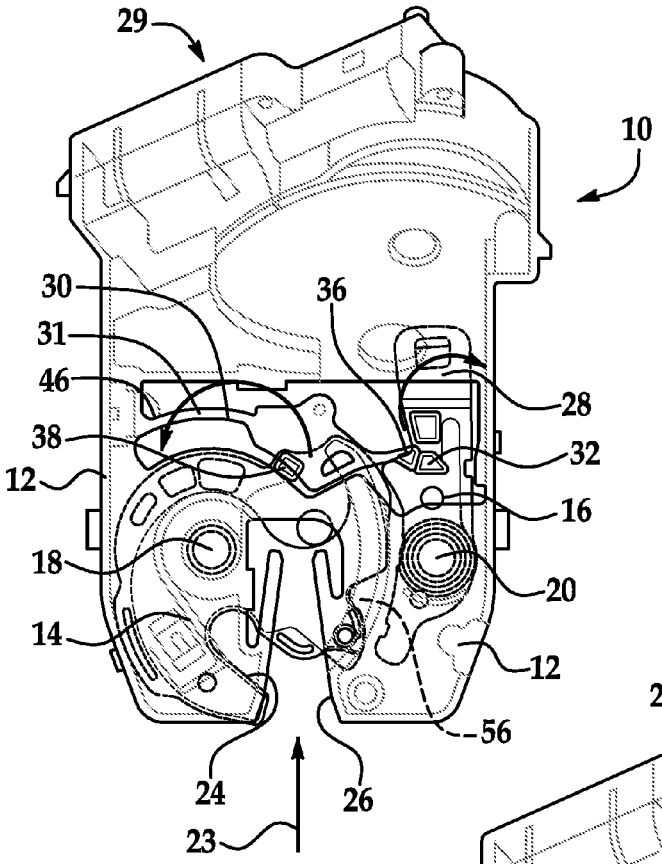
FIGS. 1, 1A and 2 illustrate movement of a fork bolt of a latch between an open position to a latched or closed position.
Figure 1A:
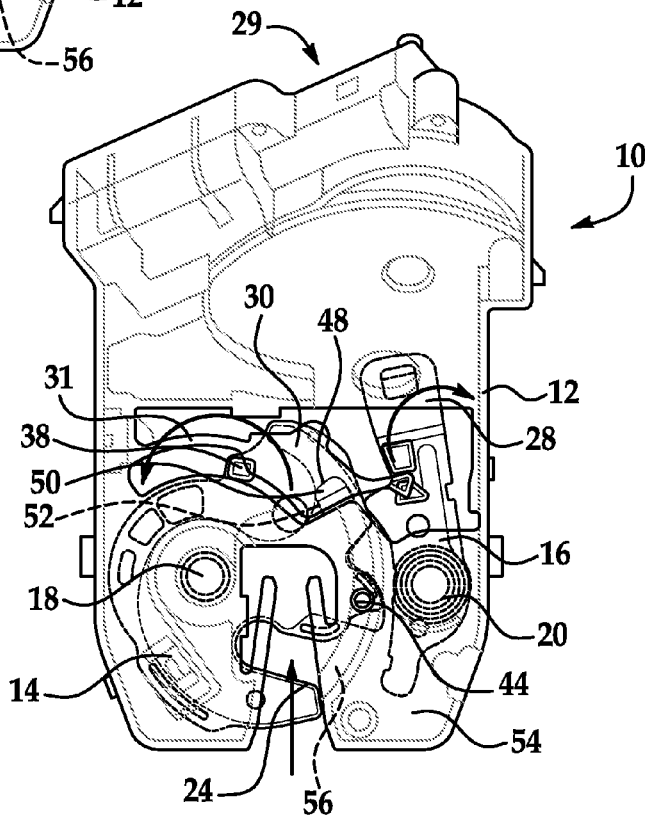

As mentioned above, certain latches are provided with a hold open lever. In particular, one non-limiting design is incorporated into a rear liftgate latch. This latch with the hold open lever provides a means for retaining the detent lever in an open position or non-engagement position after it has been power released and the door remains in the closed position due to ice buildup or snow or any other force applied to or around the door. In order to provide this feature, the hold open lever is spring biased from a non-engagement position into an engagement position that causes a portion of the hold open lever to contact the detent lever and retain the same in an open position after it has been moved from a closed position.

Accordingly, the hold open lever due to a spring biasing force moves from a non-engagement position to an engagement position and engages the detent lever when the detent lever is moved from a first position or engagement position to a second position or non-engagement position. Thereafter and in one embodiment and as the fork bolt is moved from a latched position to an open position, the hold open lever no longer engages the detent lever and the detent lever is positioned to make contact or reengage with the fork bolt once the fork bolt is moved or rotated back into its latched position.

Reference is made to the following U.S. Pat. Nos. 3,969,789; 6,568,741; 6,679,531; 8,348,310 and U.S. Patent Publication Nos. US 2010/0127512; US 2011/0204659; US 2012/0292927, the entire contents each of which are incorporated herein by reference thereto.

Referring now to the FIGS. various embodiments of the invention will be described with reference to specific embodiments, without limiting same, FIGS. 1-9 shows a latch or latch assembly 10, with portions of the cover or housing 12 of the latch 10 shown in phantom to facilitate workings of the latch 10. In the exemplary embodiment shown, latch 10 is a compartment latch. A compartment latch 10 of the type shown is useful for the rear compartment, such as a trunk of a vehicle. The latch 10 can keep the trunk lid latched, can keep a lift gate of a vehicle latched or a sliding door of vehicle closed, such as a van door. Still further the latch 10 can be used with any vehicle door.

However, the latch 10 is applicable to any environment where the features of various embodiments of the invention are desired. For example, the latch assembly can be attached to a vehicle structure such that the fork bolt is moved between the open position and the closed position when a hood, door, window, lift gate, etc. is opened and closed and the fork bolt engages a striker that is attached to the hood, door, window, lift gate, etc.

Alternatively, the latch 10 or latch assembly 10 can be secured to the hood, door, window, lift gate, etc. and the striker is secured to the vehicle body at an opening into which the hood, door, window, lift gate, etc. is received.

Latch 10 is located on a first element or first vehicle component which is either a frame (e.g., body member surrounding or proximate to an opening the movable member covers) or movable member (e.g., door, window, lift gate, hood, etc.) and includes a fork bolt 14 and a detent lever 16. Each of which are pivotally or movably mounted to the housing 12 or a portion of the latch 10. In one non-limiting embodiment, the fork bolt 14 is capable of rotation about first stud or pin 18, while detent lever 16 is a capable of rotation about a second stud or pin 20. During operation, a striker 22 is attached to a second element or movable member or second vehicle component, which is either the frame or movable member depending on which one has the latch 10 secured thereto.

In accordance with an exemplary embodiment, the fork bolt 14 is capable of movement between a first or latched position or closed position wherein the striker 22 is engaged by a throat 24 of the fork bolt and a second or open position wherein the striker is free to be released from the throat 24 of the fork bolt 14. The housing 12 of the latch 10 will also have a complimentary opening 26 for receipt of the striker 22 therein when it is engaged or latched by the fork bolt 14. In one non-limiting embodiment, the fork bolt 14 may be spring biased into the second or open position by a spring or biasing member.

Alternatively or in addition to the spring biasing force applied to the fork bolt 14, the movable member may also be spring biased or biased into an open position such that when the latch 10 is released fork bolt 14 will rotate and release striker 22. One non-limiting example of an item providing such a force is the compressed weather stripping or sealing member located around the periphery of the opening that is covered by the movable member. In other words, when the door is closed, the sealing member is compressed and the latch 10 engages the striker 22. Thereafter and when the latch 10 is released, the sealing member may provide an urging force to open the door or gate, etc. However and as mentioned above, when a force is applied to the movable member, or when the latch 10 is in a very cold environment (e.g., below freezing) these biasing forces (spring or otherwise) may not be sufficient to move the member into an open position such that the striker 22 is removed from the throat 24 of the fork bolt 14.

During operation and in order to retain the latch 10 or fork bolt 14 in the latched position, the detent lever 16 is pivotally secured to the latch 10 for movement between an engaged position or latched position and a disengaged position or released position. When the detent lever is in the engaged position, a surface of the fork bolt is engaged by a surface of the detent lever and the fork bolt is prevented from moving toward the unlatched position from the latched position. In one non-limiting implementation, a first spring is provided for biasing the fork bolt 14 into the open position while a second spring is provided for biasing the detent lever 16 in the direction of the engaged position, such that movement of the fork bolt 14 to the latched position will cause the detent lever to move to the engaged position.

In accordance with exemplary embodiments of the present invention, the fork bolt 14 has an engagement surface or contact surface that slides along and makes contact with a complimentary engagement surface or contact surface of the detent lever 16 when the fork bolt pivots or moves from the open or unlatched position to the closed or latched position and once in the closed position a surface of the fork bolt 14 engages a surface of the detent lever 16 thus engaging the fork bolt 14 and securing it into the closed position when the striker 22 is secured in a receiving opening or throat 24 of the fork bolt 14. Once the latch 10 is in the closed position the detent lever 16 is spring biased into contact with the fork bolt 14 such that the fork bolt 14 cannot rotate into the open position unless the detent lever 16 is moved back to the release or disengaged detent position.

In order to move the detent lever 16 to the released or disengaged position, a release mechanism or power release mechanism 29 operably coupled to the detent lever 16 is configured to move the detent lever 16 from the engaged position to the disengaged position upon actuation of the release mechanism.

As illustrated in the attached FIGS., housing portion 12 is shown partially in phantom to illustrate the fork bolt 14 and the detent lever 16, which are each attached to a portion of the housing 12.

In operation, the latch 10 is moved from the latched state to an unlatched state by initiating rotation of detent lever 16 in a direction depicted by arrow 28 against a spring bias (not shown). The rotational force applied to detent lever 16 can be initiated manually or by an automatic power release mechanism 29. Once this rotational force is released, the spring bias acting on the detent lever 16 will cause the detent lever 16 to rotate in a direction opposite to arrow 28 until detent lever 16 again engages fork bolt 14. Similarly and when the detent lever 16 is in the disengaged position, a spring force will rotate the fork bolt 14 into the unlatched or open position. If the fork bolt 14 has not rotated to the open position shown in FIG. 1, the detent lever 16 will rotate back into the engaged position and once again engage a shoulder portion of the fork bolt 14, causing the latch 10 to remain in a latched position or state. This situation may occur when, for example, the pistons that cause trunk lid or lift gate to open do not function properly. In another example, a snow load placed on the trunk lid (or another weight) may prevent the trunk lid or other item (e.g., door, lift gate etc.) from opening when the detent lever 16 is rotated out of the closed position. Another example wherein the fork bolt 14 does not transition into the open position is the freezing of the door or member to the vehicle so that the compressed sealing member will not bias the door or member open.

Thus, when the rotation force on the detent lever 16 is released and striker 22 has not been removed from throat 24, detent lever 16 rotates back to the closed position. Accordingly, the trunk, lid, door, hatch or other member used by latch 10, therefore, does not open as intended.

In order to prevent this, the housing 12 is provided with a hold open lever 30. In one non-limiting exemplary embodiment, hold open lever 30 is integrally formed with a portion of the housing 12. One non-limiting example of such a hold open lever 30 is described in U.S. Pat. No. 8,348,310, the entire contents of which are incorporated herein by reference thereto.

In one non-limiting exemplary embodiment, the housing 12 or a portion thereof and the hold open lever 30 or a portion thereof is formed of a plastic or other equivalent easily molded material or equivalents thereof that is integrally molded with the housing 12 for example at the same time the housing is formed. Alternatively, the hold open lever 30 may be inserted molded into the housing 12 or still in another alternative fixed to the housing 12 separately. Although exemplary embodiments are directed to a plastic housing and housing arm other equivalent materials are considered to be with the scope of various embodiments of the invention.

In order to facilitate engagement of the hold open lever 30 with the detent lever 16, the detent lever 16 includes a hook or feature 32 raised in relief off of a front surface 34 of the detent lever 16 so that it projects outwardly and away from the detent lever 16 and is configured to releasably engage a stop portion 36 of hold open lever 30. In one non-limiting exemplary embodiment, feature 32 is formed from an encapsulation provided upon the detent lever 16 for example, a thermoplastic elastomer or other equivalent material applied to the detent lever 16, which may be formed from steel, metal, plastic or any other suitable material. Fork bolt 14 also includes a finger or first feature 38 extending from a surface 40 of fork bolt 14 in a manner complementary to feature 32. In one non-limiting exemplary embodiment, feature 38 is also formed from an encapsulation provided upon the fork bolt for example, a thermoplastic elastomer or other equivalent material applied to the fork bolt, which may be formed from steel, metal, plastic or any other suitable material. Operation of the hold open lever 30, fork bolt 14, detent lever 16 and features 32, 36 and 38 are similar to those disclosed in U.S. Pat. No. 8,348,310, the contents of which are incorporated herein by reference thereto.

During desired operation and when detent lever 16 is rotated in the direction of arrow 28, feature 32 moves past stop portion 36 by sliding along first complementary edges of each. In addition, hold open lever 30 will move upwardly in the direction of arrow 42. Hold open lever 30 or at least a living hinge portion 31 of the same will be formed out of a material having resilient characteristics such that a biasing force in a direction opposite to arrow 42 is provided. Accordingly, as hook or feature 32 contacts and moves in the direction or arrow 28 or as detent lever 16 moves in a clockwise direction. Hold open lever 30 moves upward in the direction of arrow 42 and then after feature or hook 32 moves past stop portion 36 the biasing force of the hold open lever 30 or the living hinge portion thereof will move the same in a direction opposite to arrow 42 and stop portion 36 will now be in a position to contact hook or feature 32 as it tries to move in a direction opposite to arrow 28 or in a counter clockwise motion as illustrated in the FIGS.

As discussed above, contact of hook portion or feature 32 with stop portion or feature 36 causes hold open lever 30 to move from a first rest position to a second biased position, about a living hinge portion of the hold open lever 30, until hook or feature 32 moves past stop portion 36. Thereafter, the biasing force of the hold open lever 30 brings the stop portion or feature 36 back to the first rest position. In this position, hook or feature 32 engages stop portion 36, thus preventing detent lever 16 from biasing back counterclockwise in a direction opposite to arrow 28 to a closed or engaged position.

While this may be desirable for certain operational states of the latch 10, it is also desirable to provide a means to move the hold open lever 30 away from engagement with the detent lever 16 so that when the latch 10 or fork bolt 14 is moved into the closed position detent lever 16 is free to move into its engagement position with fork bolt 14.

In order to ensure that the hold open lever 30 releases or allows the detent lever 16 to move into the latched or engaged position when the fork bolt 14 is in the closed position a second feature or boss 44 protrudes upwardly from the surface 40 of the fork bolt 14. In one non-limiting embodiment, the second feature or boss 44 is included in the fork bolt encapsulation. Second feature or boss 44 is configured to push the hold open lever 30 to the disengaged or released position when the fork bolt 14 reaches a predetermined position. In one non-limiting exemplary embodiment, this predetermined position is a position where the fork bolt 14 over travels in the direction of arrow 46 past the closed position of the fork bolt 14. In one non-limiting exemplary embodiment, this predetermined position is approximately 0.5 mm of over travel of the striker 22 or 2 degrees of rotation of the fork bolt 14 in the direction of arrow 46. Of course, the aforementioned distance or rotation of over travel is merely a non-limiting exemplary embodiment and the various embodiments of the present invention are not intended to be specifically limited to the dimensions provided herein. Alternatively, second feature or boss 44 may be positioned to push or move the hold open lever 30 to the disengaged or release position when the fork bolt reaches the closed position.

In one embodiment, it is been found that closure of the latch 10 at specific speeds (e.g., angular velocity of the fork bolt 14 or closing velocity of striker 22) may utilize the second feature or boss 44 in order to push or move the hold open lever to the second or biased or disengaged or released position from a first or rest or engaged position. For example, and when the latch 10 is closed below a particular speed second feature or boss 44 will not contact the hold open lever 30 or will not be required to contact the hold open lever 30 in order to allow the detent lever 16 to engage the fork bolt 14 when it is moved into the closed position. One non-limiting exemplary range of a closure speed of the striker 22, which would utilize second feature or boss 44 is a velocity greater than 0.9 m/sec in the direction of arrow 23. Of course, velocities above and below the aforementioned value are considered to be within the scope of exemplary embodiments of the present invention, and various embodiments of the present invention are not intended to be specifically limited to the aforementioned values. In other words, while boss 44 is configured to contact the hold open lever 30 when the fork bolt 14 rotates into a predetermined position, the engagement of the hold open lever 30 with the detent lever 16 or the position of the detent lever 16 with respect to the hold open lever 30 may be dependent upon the speed at which the striker 22 enters the latch 10 or the fork bolt 14 and ultimately affect the angular velocity of the fork bolt 14 in the direction of arrow 46.

In another example, if the latch 10 is released by for example, the power release mechanism 29 and the door the latch 10 is secured to remains in a closed position due to any external force, an individual may be able to disengage the hold open lever 30 without having to open and close the door by for example applying a closure force to the door such that the fork bolt 14 over travels past the closed position to a position where protrusion or boss 44 engages the hold open lever 30 and moves the hold open lever 30 to a desired position away from engagement with the detent lever 16.

As illustrated and in one embodiment, the fork bolt 14 has a pair of protrusions or features 38, 44 which extended upwardly from a surface 40 of the fork bolt 14. In one embodiment, feature or protrusion 44 makes contact with a surface 48 of the hold open lever 30 in order to provide the desired movement of the hold open lever 30 in the direction of arrow 42. In one non-limiting embodiment, surface 48 is located within an opening 50 of the hold open lever 30.

In order to allow for the rotational movement of the fork bolt 14 from the closed position to the over travel position and from the over travel position to the closed position, as well as between the open and closed positions a lower surface of the hold open lever 30 is configured to have a channel 52 such that boss or protrusion 44 can travel underneath hold open lever 30, until it engages and makes contact with surface 48 causing the same to move in the direction of arrow 42, when the fork bolt moves into the over travel position.

In one non-limiting exemplary embodiment, movement of the fork bolt in the direction of arrow 46 from the closed position to the over travel position is approximately 2° of rotational movement of the fork bolt. Of course, numerical values or degrees of movement, greater or less than the previously mentioned values are considered to be within the scope of exemplary embodiments the present invention.

Figure 2:
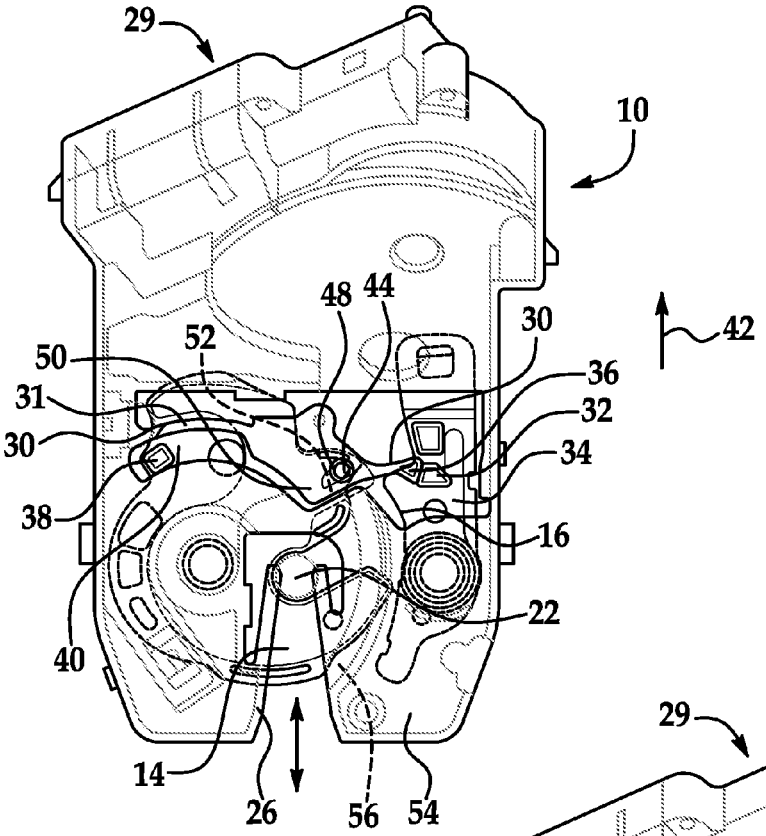
Figure 3:
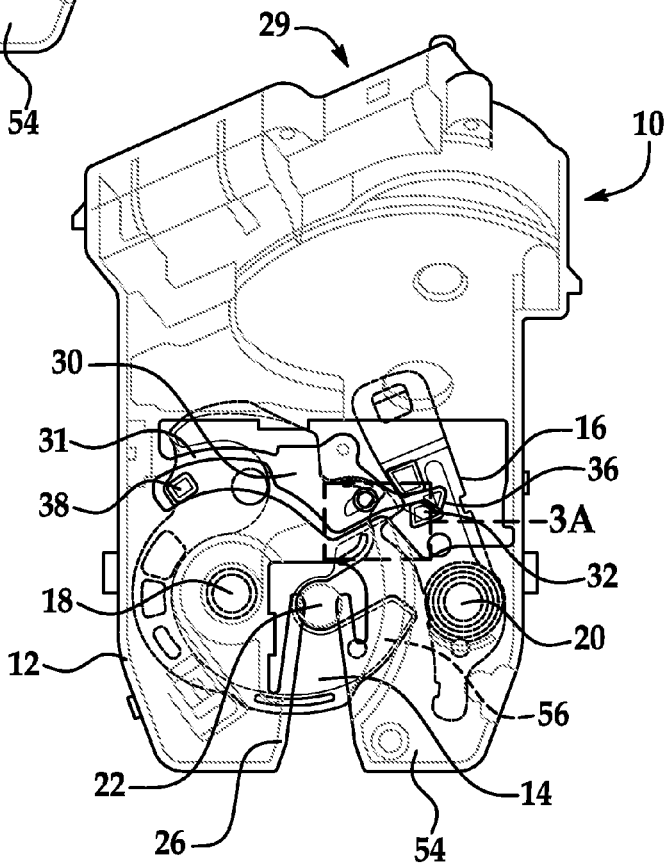
FIGS. 3 and 3A illustrate features of various exemplary embodiments of the present invention.
Figure 3A:
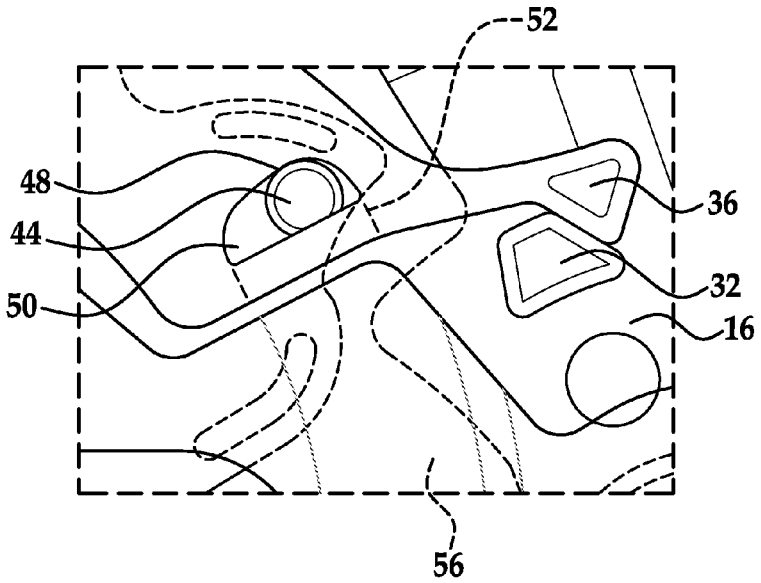
Figure 4:
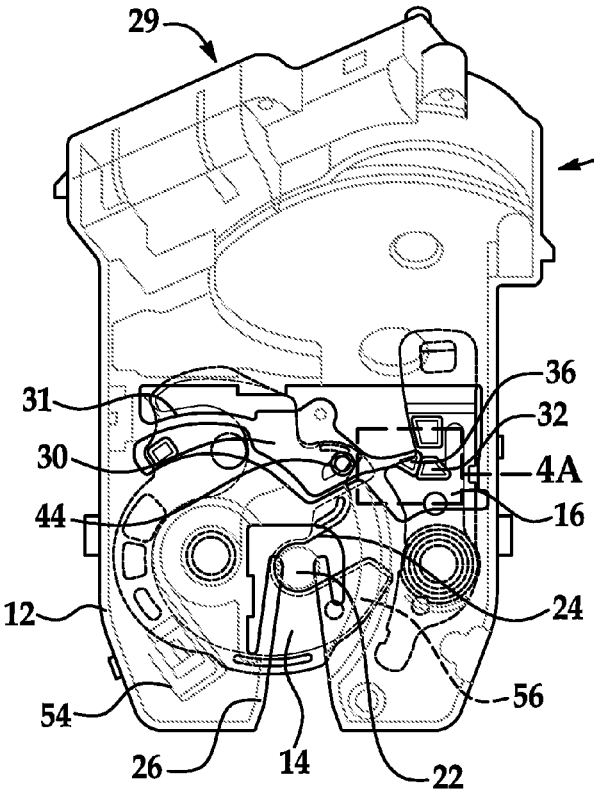
FIGS. 4 and 4A illustrate the fork bolt in a primary position and the hold open lever engaging the detent lever.
Figure 4A:
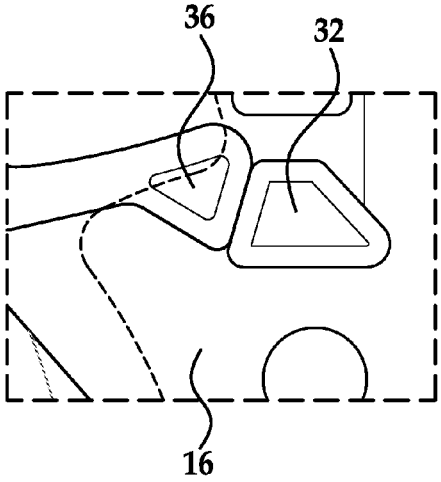
Figure 5:
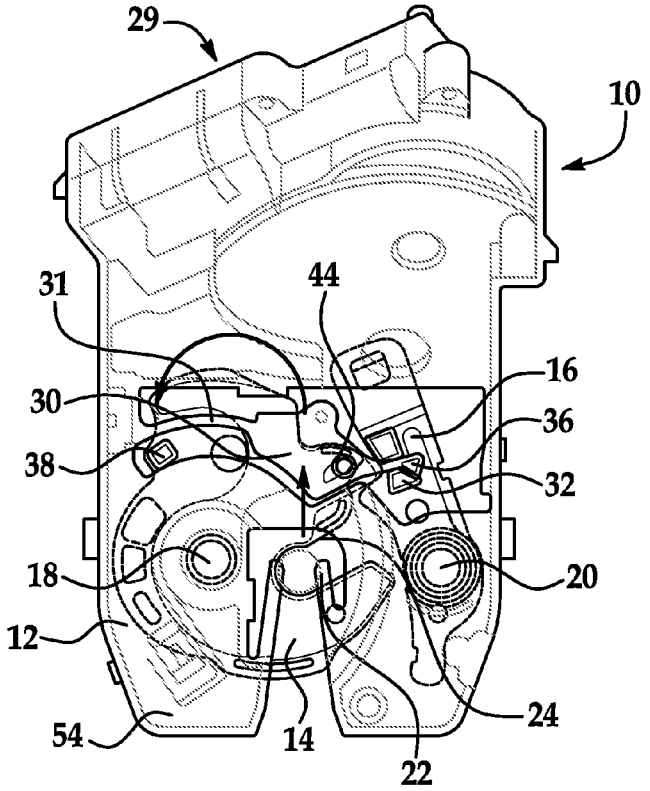
FIG. 5 illustrates disengagement of the hold open lever.

Still further and in order to allow for the fork bolt to rotate from the closed position illustrated in FIG. 2 to the open position illustrated in FIG. 1. A housing portion 54 of the housing 12 is configured to have a channel or groove 56 located on a lower surface of the housing portion 54, so that boss or feature 44 does not make contact with housing portion 54 and allows rotational movement of the fork bolt 14 in the direction of arrow 46 as well as in a direction opposite to arrow 46.

Figure 10:
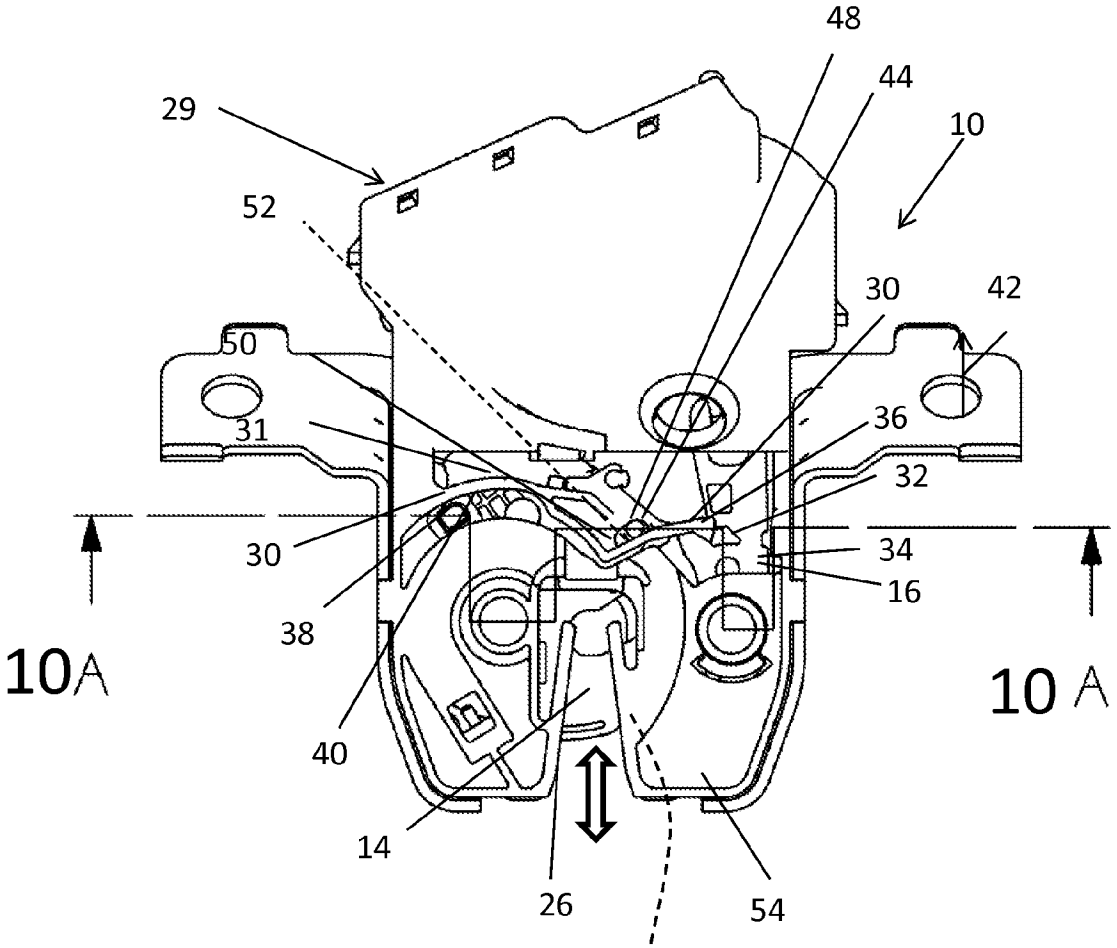
FIG. 10 illustrates a latch and FIG. 10A is a cross-sectional view of the latch along lines 10A-10A of FIG. 10.
Figure 10A:
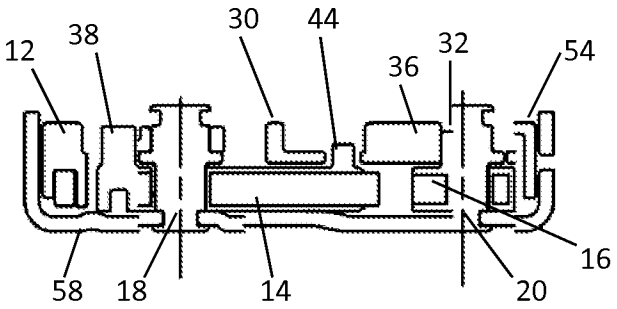

Referring now to FIG. 10A, a cross-sectional view of a portion of the latch 10 is illustrated. As illustrated, the fork bolt 14 and the detent lever 16 may be pivotally secured to a frame plate 58 of the housing 12 between the frame plate 58 and housing portion 54. As mentioned above and in one non-limiting exemplary embodiment, the hold open lever 30 is integrally formed with housing 12 and is located above the fork bolt 14 and the detent lever 16. In one non-limiting embodiment, the fork bolt 14 and the detent lever 16 are configured for pivotal or rotational movement in a first plane 70 and the hold open lever 30, protrusion or bosses 32, 38 and 44 are configured for movement in a second plane 72, which in one embodiment is spaced from the first plane 70 and is parallel thereto. Accordingly and as the fork bolt 14 and the detent lever 16 move in the first plane 70 corresponding movement of the hold open lever 30, protrusion or features 38, 44 and 32 will occur in the second plane 72.

Figure 6A:
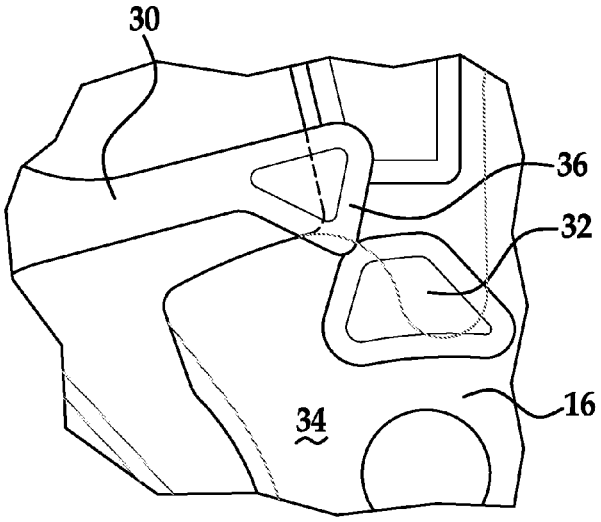
FIGS. 6A and 6B illustrate features of various exemplary embodiments of the present invention.
Figure 6B:
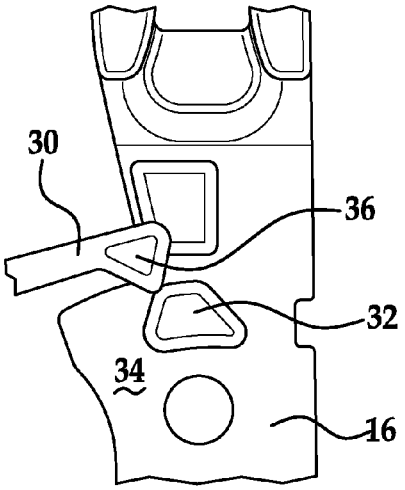
Figure 7:
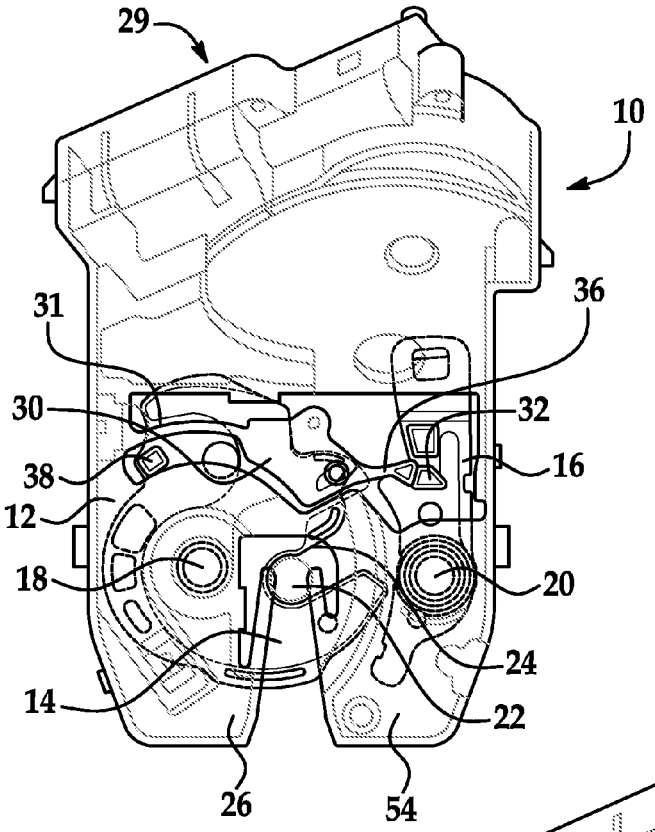
FIGS. 7-9 illustrate a disengagement sequence of the hold open lever.
Figure 8:
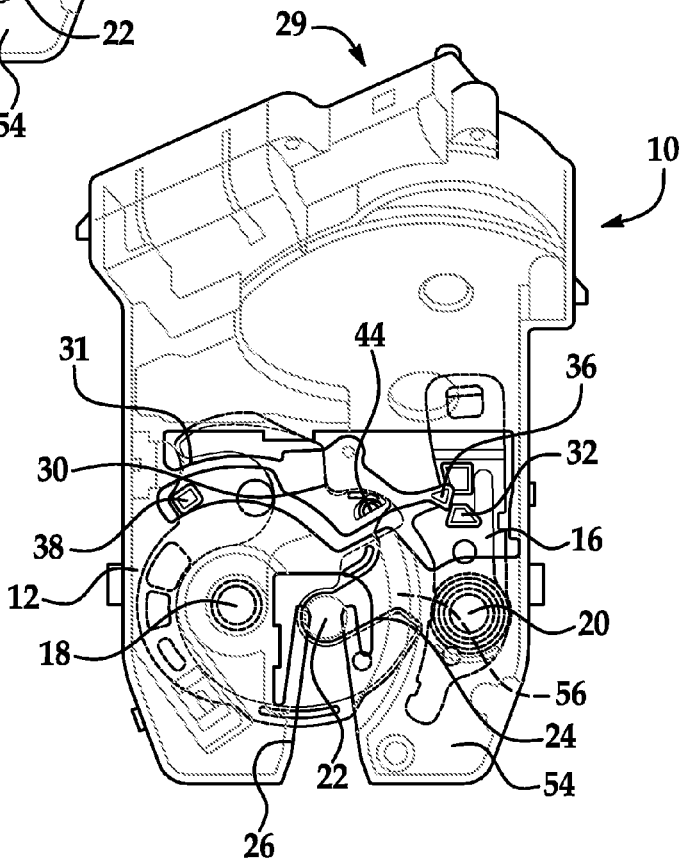
Figure 9:
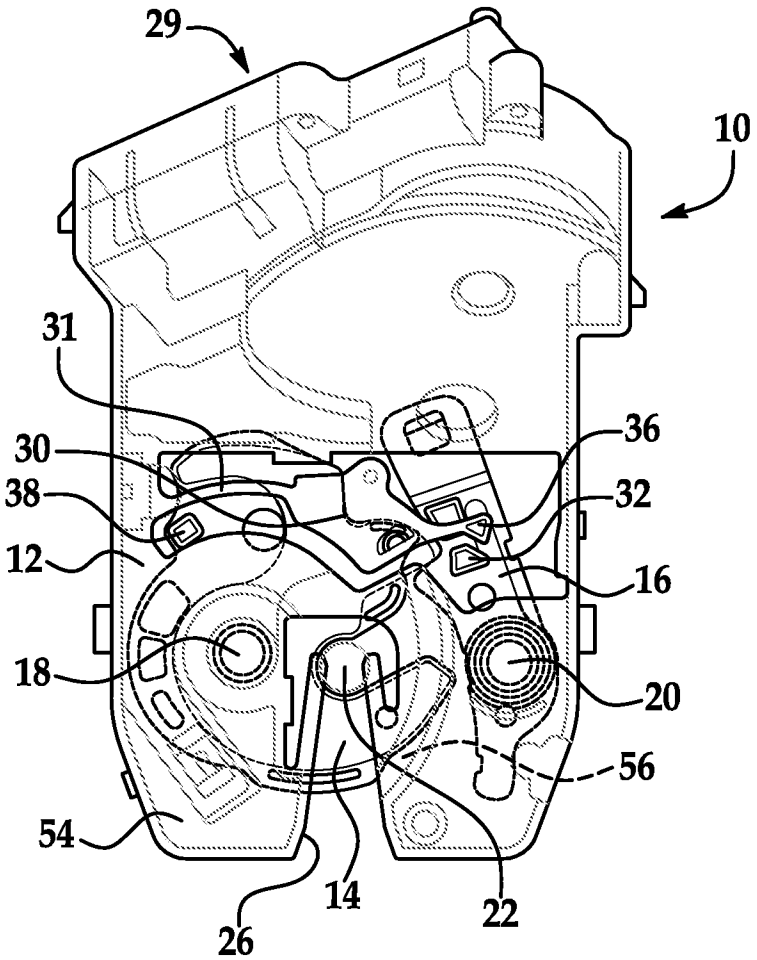

As mentioned above, and when the fork bolt moves into the over travel position second feature or boss 44 contacts surface 48 in opening 50 and stop portion 36 is moved out of engagement with a feature 32 (see at least FIG. 6A). In one exemplary embodiment, it is only necessary to provide a clearance of approximately 0.75 mm, in order to allow the detent lever 16 to no longer be engaged with the hold open lever 30. Of course, various exemplary embodiments of the present invention are not limited to the clearance dimension provided above and dimensions greater or less than the aforementioned value are contemplated to be within the scope of various embodiments of the present invention.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

What is claimed is:

1. A latch, comprising:

a fork bolt movably mounted to a support portion of the latch for movement between an open position and a closed position;

a detent lever movably mounted to the support portion of the latch for movement between a latched position and a released position, wherein the detent lever prevents the fork bolt from moving from the closed position to the open position when the detent lever is in the latched position;

a hold open lever configured to engage and retain the detent lever in the released position after it has moved from the latched position to the released position; and wherein the fork bolt is configured to disengage the hold open lever from the detent lever when the fork bolt travels away from the closed position in a closing direction to an over travel position just past the closed position, wherein the closing direction corresponds to movement of the fork bolt in direction from the open position towards the closed position.

2. The latch as claim 1, wherein the hold open lever is integrally formed with a housing of the latch.

3. The latch as claim 2, wherein the hold open lever is formed from plastic.

4. The latch as in claim 1, wherein the fork bolt is configured to disengage the hold open lever from the detent lever when the fork bolt travels from the closed position to the open position.

5. The latch as in claim 1, wherein the fork bolt and detent lever are movably mounted within a housing and wherein the hold open lever is integrally formed with a portion of the housing.

6. The latch as claim 5, wherein the hold open lever is formed from plastic.

7. The latch as claim 1, wherein a protrusion of the fork bolt is configured to disengage the hold open lever from the detent lever when the fork bolt travels from the open position towards the position just past the closed position.

8. The latch as claim 7, wherein the protrusion passes through a channel in the hold open lever prior to it contacting the hold open lever and disengaging it from the detent lever.

9. A latch, comprising:

a fork bolt movably mounted to a support portion of the latch for movement between an open position and a closed position;

a detent lever movably mounted to the support portion of the latch for movement between a latched position and a released position, wherein the detent lever engages the fork bolt and prevents the fork bolt from moving from the closed position to the open position when the detent lever is in the latched position;

a hold open lever movably mounted to the latch for movement between a first position and a second position, wherein the hold open lever is configured to engage and retain the detent lever in the released position when the hold open lever is in the first position and wherein the hold open lever allows the detent lever to travel into the latched position when the hold open lever is in the second position, wherein the hold open lever is spring biased into the first position and the detent lever is spring biased into the latched position; and wherein the fork bolt has a first feature configured to move the hold open lever from the first position to the second position when the fork bolt travels from the closed position to the open position and wherein the fork bolt has a second feature configured to move the hold open lever from the first position to the second position when the fork bolt travels from the open position to the closed position and wherein the second feature only contacts the hold open lever when the fork bolt travels to an over travel position which is slightly past the closed position of the fork bolt.

10. The latch as in claim 9, wherein the first feature only contacts the hold open lever when the fork bolt travels to the open position from the closed position.

11. The latch as in claim 9, wherein the first feature and the second feature extend from a surface of the fork bolt and wherein the first feature and the second feature are spaced from each other on the surface.

12. The latch as claim 9, wherein the hold open lever is integrally formed with a housing of the latch and wherein the hold open lever and the detent lever are pivotally secured to the housing.

13. The latch as claim 12, wherein the hold open lever is formed from plastic.

14. The latch as claim 9, wherein the second feature passes through a channel in the hold open lever prior to it contacting the hold open lever and moving it from the first position.

15. The latch as in claim 9, wherein portions of the fork bolt and the detent lever travel in a first plane and the first feature and the second feature travel in a second plane, wherein the first plane is parallel to the second plane and the hold open lever is located in the second plane.

16. The latch as in claim 15, wherein the first feature and the second feature extend from a surface of the fork bolt and wherein the first feature and the second feature are spaced from each other on the surface.

17. The latch as claim 16, wherein the hold open lever is integrally formed with a housing of the latch and wherein the hold open lever and the detent lever are pivotally secured to the housing and wherein the hold open lever is formed from plastic.

18. A method of disengaging a hold open lever from engagement with a detent lever of a latch, comprising:

pivotally mounting a fork bolt to the latch for movement between an open position and a closed position;

pivotally mounting the detent lever to the latch for movement between a latched position and a released position, wherein the detent lever engages the fork bolt and prevents the fork bolt from moving from the closed position to the open position when the detent lever is in the latched position;

movably mounting the hold open lever to the latch for movement between a first position and a second position, wherein the hold open lever is configured to engage and retain the detent lever in the released position when the hold open lever is in the first position and wherein the hold open lever allows the detent lever to travel into the latched position when the hold open lever is in the second position, wherein the hold open lever is spring biased into the first position and the detent lever is spring biased into the latched position; and moving the hold open lever from the first position towards the second position with a feature of the fork bolt when the fork bolt is moved to an over travel position past the closed position slightly while moving the fork bolt in a direction corresponding to motion from the open position towards the closed position.

19. The method as in claim 18, wherein the hold open lever is integrally formed with a housing the fork bolt and the detent lever are pivotally mounted to.

* * * * *